United States Patent [19]

Gustafson

[11] Patent Number: 4,893,711

[45] Date of Patent: Jan. 16, 1990

[54] CONVERTIBLE CARRYING CASE AND EXPANDABLE EASEL

[75] Inventor: Everett C. Gustafson, Vancouver, Canada

[73] Assignee: Multicard Enterprised Limited, New Westminster, Canada

[21] Appl. No.: 324,188

[22] Filed: Mar. 16, 1989

[51] Int. Cl.[4] ..... B65D 25/22; B65D 25/28; A45C 9/00

[52] U.S. Cl. ..... 206/45.24; 190/11; 190/16; 217/11

[58] Field of Search ..... 190/11, 16, 14, 18 R, 190/12 A; 206/45.29, 45.23, 45.15; 217/11

[56] References Cited

U.S. PATENT DOCUMENTS

| | | | |
|---|---|---|---|
| 336,347 | 2/1886 | Rice . | |
| 864,066 | 8/1907 | Berwick | 190/11 X |
| 1,178,597 | 4/1916 | Owens . | |
| 1,839,783 | 1/1932 | Bloom | 190/11 |
| 1,869,710 | 8/1932 | Ochse | 190/16 |
| 2,585,209 | 2/1952 | Abbott . | |
| 2,693,258 | 11/1954 | Fleisch . | |
| 3,124,266 | 3/1964 | Morgan | 206/45.24 X |
| 4,061,224 | 12/1977 | Fuhri . | |

FOREIGN PATENT DOCUMENTS

| | | | |
|---|---|---|---|
| 112436 | 3/1929 | Austria | 190/11 |
| 223481 | 6/1965 | Sweden | 190/16 |
| 534927 | 3/1941 | United Kingdom | 206/45.24 |

*Primary Examiner*—Sue A. Weaver
*Attorney, Agent, or Firm*—Wells, St. John & Roberts

[57] ABSTRACT

A convertible carrying case and expandable easel is presented by a pair of three sided trays interconnected by a liner that includes two slidable panels engaged by the respective trays and an intermediate spine that encloses the open ends of the trays when they are closed on one another. A multi-position handle is provided on each tray to facilitate suspension and carrying of the closed trays as an enclosed case. They also provide separate adjustable supports for the two trays when they are in an open side-by-side positions as an expandable easel for displaying or viewing of articles positioned within the tray boundaries.

5 Claims, 4 Drawing Sheets

CONVERTIBLE CARRYING CASE AND EXPANDABLE EASEL

TECHNICAL FIELD

This disclosure relates to a product for supporting viewable objects while in an expandable easel configuration, and convertible into an enclosed carrying case. The relative size of the product is thus minimized for carrying purposes and ease of transportation.

BACKGROUND OF THE INVENTION

This invention arose from a desire to provide an expandable open tray or easel for holding bingo cards as the game is being played by a person attempting to monitor several cards simultaneously. It was determined that the visual monitoring of several cards would be facilitated if they could be arranged in an upwardly inclined orientation that did not require the observer to continually bend over a table surface to read them. The resulting product was also designed to be adaptable to users viewing different numbers of cards and cards of different sizes. By expanding or contracting the size of the tray described herein, it can be readily adapted to specific display or viewing needs of a user, as well as to table space limitations that might be encountered. Finally, the tray or easel was designed to be contracted in size and folded for use as a carrying case, within which the user can safely carry or store related articles, such as marking pens, etc.

As the tray was developed, many additional uses have been identified. Students, professionals, office workers, homemakers and hobbyists can readily identify many different uses for the expandable and convertible product that has resulted from this development. As examples, the open tray or easel can hold cookbooks, recipes and magazines at an adjustable angle that can be selected and readily changed. It also can be used for visually presenting drawings, plans, prints and brochures for home or business presentations. The framing effect of the tray or easel and adjustability of its viewing angle has been found to enhance such presentations. It can be used for displaying coins, jewelry, and miniature collectible items, which can be attractively displayed within the opened tray or easel. If desired, felt or other fabric can be used as a background within the open product to provide a display case having a professional appearance. As a study aid, the tray or easel can conveniently hold text books, encyclopedias, atlases and other books for easy reference while researching, reading or copying information. The inclined angle of the display product permits adjustment of room light on the open pages and reduces eye strain while reading them. Stamp or coin collectors can display their materials within the open tray or easel to facilitate research as well as display of these items.

In general, the product can be conveniently adjusted for any table top viewing application. The open tray provides complete ease of viewing for computer, accounting, or secretarial entry purposes. It can accommodate large books, directories or catalogs of any thickness, and also allows convenient placement and organization of disks, notes, pens, pencils and other items utilized for this purpose. It quickly folds into a unique storage or carrying case as required, and effectively protects small items enclosed within it as they are being carried. When folded as a carrying case, the product supplies an excellent protective case for such items.

BRIEF DESCRIPTION OF THE DRAWINGS

The preferred embodiment of the invention is illustrated in the accompanying drawings, in which.

DETAILED DESCRIPTION OF THE PREFERRED EMBODIMENT

The following disclosure of the invention is submitted in compliance with the constitutional purposes of the Patent Laws "to promote the progress of science and useful arts" (Article 1, Section 8).

Figure 1:
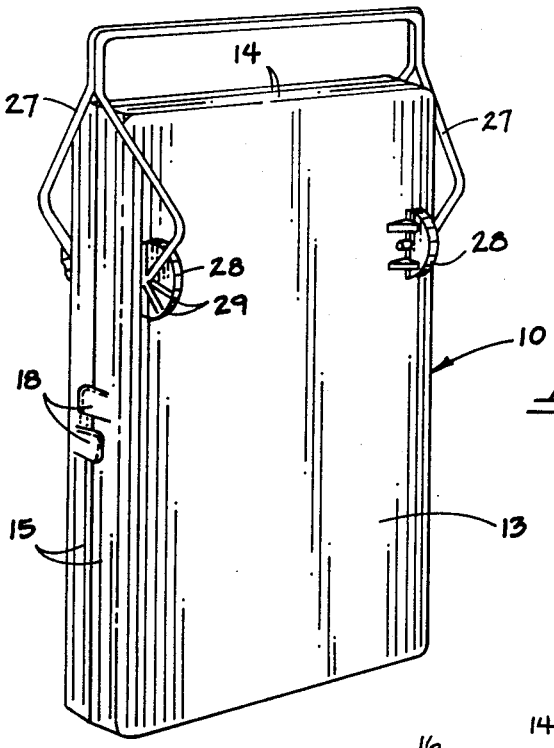
FIG. 1 is a perspective view of the closed case.
Figure 2:
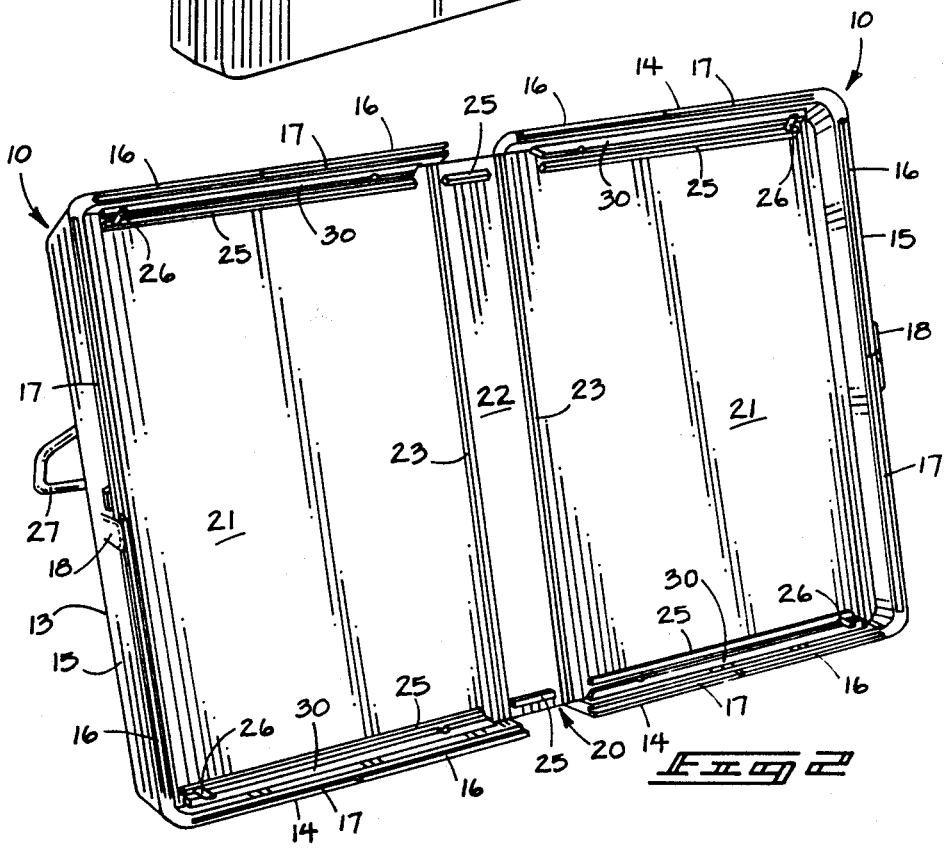
FIG. 2 is a perspective view of the opened case prior to expansion.
Figure 3:
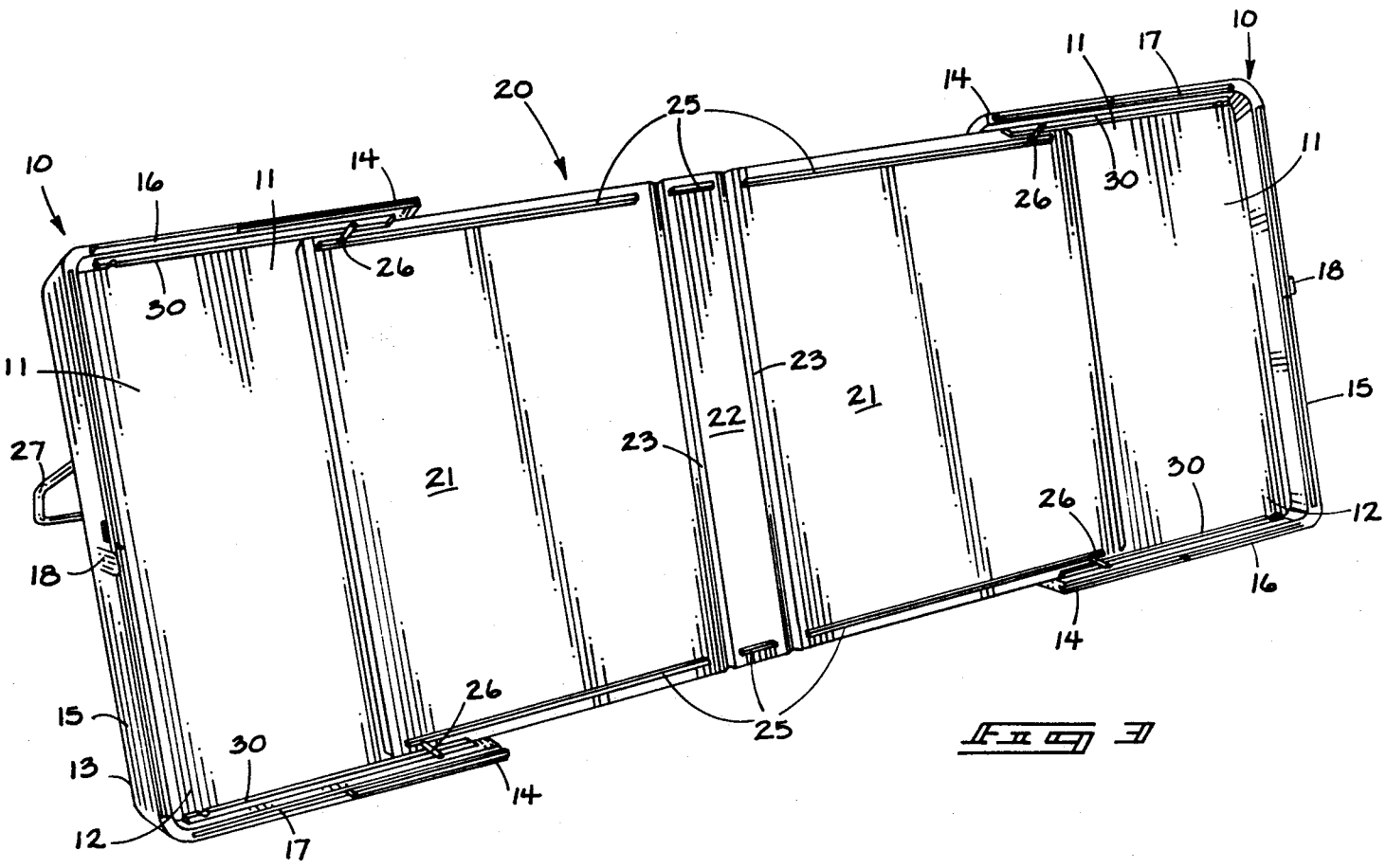
FIG. 3 is a perspective view of the case after full expansion.
Figures 4, 5:
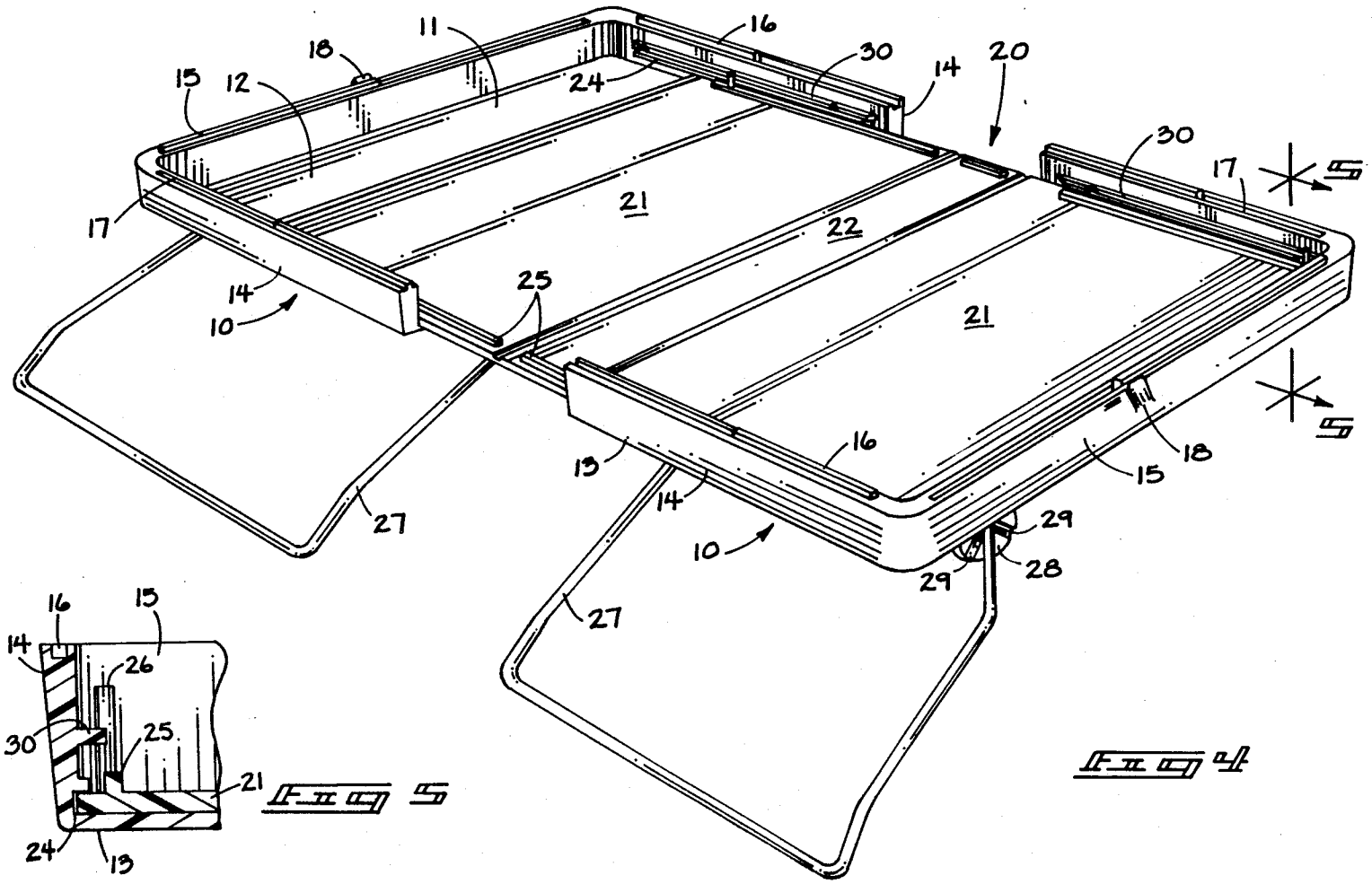
FIG. 4 is a perspective view showing the manner of expansion.
FIG. 5 is an enlarged fragmentary sectional view taken along line 5—5 in FIG. 4.
Figure 6:
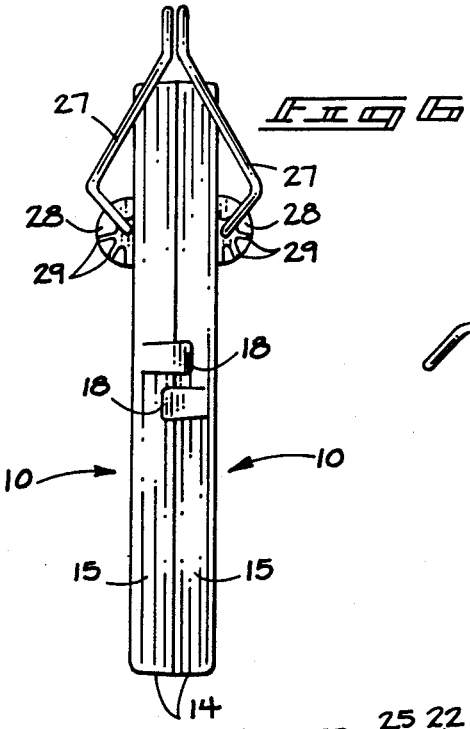
FIG. 6 is a side view of the closed case.
Figure 7:
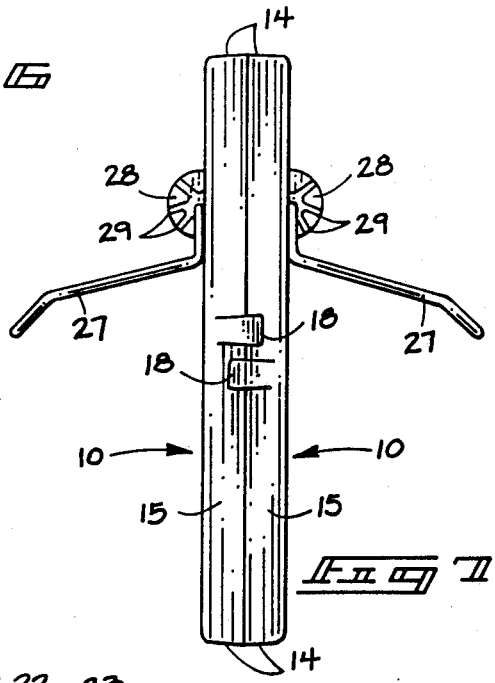
FIG. 7 is a side view showing the handles in an opposite extreme position.

The attached drawings illustrate a preferred embodiment of the convertible carrying case and expandable easel. FIGS. 1, 6 and 7 show the product when closed as a carrying case within which items can be effectively protected and transported as the case is suspended by opposed handles at each side. FIGS. 2–4 show the open and expanded tray or easel for table top viewing or presentation purposes. The inclined angle presented by the upwardly facing interior surfaces across the open tray or easel can be varied by adjustment of the handles that serve as supports for the tray or easel while it is resting on a table or other horizontal surface.

The carrying case and easel comprises a pair of identical three sided trays 10 and an interconnecting liner 20. The liner is slidably guided within each tray to serve as an intermediate planar element joining the opened trays in side-by-side positions as an easel. It alternately hinges the two trays relative to one another so that they can be folded to a closed condition in the carrying case configuration.

Each tray 10 has a rectangular bottom 11 with oppositely facing inner and outer surfaces 12 and 13. The inner surface 12 of each tray bottom is partially rimmed by three walls, shown as parallel side walls 14 and a perpendicular end wall 15. The two parallel side walls 14 extend across the width of the bottom 11 of each tray and are joined to the perpendicular end wall 15.

The walls 14 and 15 of the two trays 10 have complementary peripheral edges adapted to abut one another when the trays 10 are closed to form an enclosure that is opened across one end of the folded trays. For sealing purposes, these peripheral edges include projecting ribs 16 to one side of tray 10 and complementary peripheral grooves 17 located at the remaining side. When trays 10 face one another, the ribs 16 and grooves 17 abut one another to interlock their abutting edges along walls 14 and 15.

Each tray is also provided with a protruding latch 18 that is located on the outer surface of its end wall 15. The latches 18 are designed to overlap the adjacent end wall 15 of an abutted tray 10 when the trays are closed, thereby providing a releasable frictional lock to maintain the trays in their closed position for travelling purposes. Other latches or locks can be provided for this purpose as desired.

Figure 9:
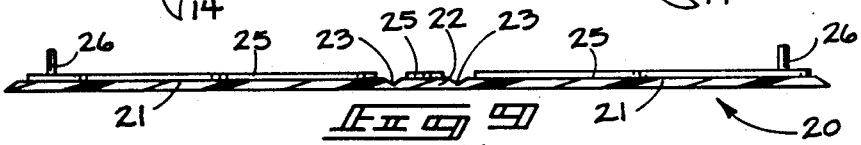
FIG. 9 is a sectional view of the liner as seen along line 9—9 in FIG. 8.
Figure 8:
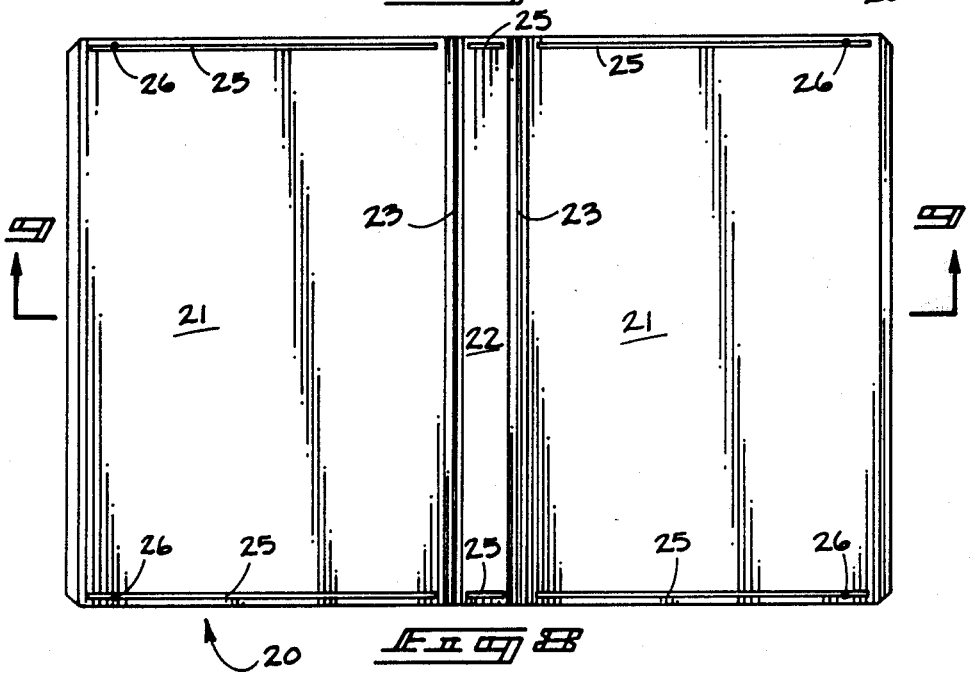
FIG. 8 is a plan view of the liner.

The liner 20 is shown as being constructed from a single planar sheet of plastic material, although it can be formed from three sheets hingedly joined to one another if this is desired. Liner 20 includes first and second rectangular panels 21 hinged to a central spine 22 along two parallel hinged axes shown by scored lines 23 (FIGS. 8 and 9). Panels 21 can be provided with reinforcing ribs across their back surfaces to provide additional stiffness to them.

the liner 20 interconnects the two trays 10 by engagement between the first and second panels 21 and the first and second trays 10, respectively. Each panel 21 is positioned adjacent to the inner surface 12 of a tray bottom for relative sliding movement between them in directions perpendicular to the hinge axes and in the planes of the respective panels 21. Each tray 10 is independently slidable relative to the liner 20 to effectively expand or contract the width presented across the bottom of the tray. As shown in FIG. 5, the side edges across the panels 21 are slidably received within longitudinal grooves 24 formed along the inside surfaces of the parallel sides walls 14 at positions adjacent to the tray bottoms 11.

The side edges across the panels 21 also include raised ribs 25 provided with a cylindrical post 26 at their outer ends. Posts 26 are somewhat yieldable, due to their substantial height, and rub along inwardly directed ribs 30 formed along the inner surfaces of side walls 14 within each tray 10. This frictional engagement holds the trays 10 relative to the interconnecting liner 20. Indented recesses 31 are located adjacent the ends of each rib 30. They receive posts 26 (as shown in FIG. 5) to act as detents, securely fixing the extreme open and closed positions of each tray 10 along the liner 20.

Handles 27 are provided at the exterior of each tray 10 for suspending the trays and interconnecting liner while the trays 10 are closed (FIGS. 1 and 6) and for alternately supporting the trays 10 in side-by-side positions along the liner while resting in upwardly-open, inclined positions (FIGS. 2 and 3).

The width of each panel 21 is equal to or less than the width of each inner surface 12 across the respective tray bottoms 11 (parallel to the side walls 14). It is preferable that the panel width be equal to the tray bottom width so that the panel fully overlaps and covers the tray bottom when the unit is contracted and folded for carrying purposes. This size relationship also provides maximum expansion capability to the unit when opened as an easel.

The width of spine 22 is equal to the combined heights of the side walls 14 or end walls 15 about the closed trays 10, thereby assuring that spine 22 extends across and encloses the open end of the enclosure presented by the closed trays 10.

The illustrated handles 27 are bent to provide a multipurpose support for carrying the closed trays and for positioning the opened trays and liner. The handles 27 are pivotally mounted within protruding brackets 28 at the exterior of each tray 10. The sides of the handles engage grooves 29 formed radially about the outer surface of each bracket 28 to permit positioning of the handle in several positions when the trays 10 are open, and facilitating the grasping of both handles adjacent to one side wall 14 of each tray 10 when the trays 10 are closed.

In compliance with the statute, the invention has been described in language more or less specific as to structural features. It is to be understood, however, that the invention is not limited to the specific features shown, since the means and construction herein disclosed comprise a preferred form of putting the invention into effect. the invention is, therefore, claimed in any of its forms or modifications within the proper scope of the appended claims, appropriately interpreted in accordance with the doctrine of equivalents.

I claim:

1. A convertible carrying case and expandable easel, comprising:

first and second three-sided trays, each tray having a bottom with oppositely facing inner and outer surfaces, the inner surface of each bottom being partially rimmed by three walls, the walls of the first and second trays having complementary peripheral edges adapted to abut one another when the trays are closed to form an enclosure that is open across one end;

a liner having first and second rectangular panels hinged to a central spine along two parallel hinge axes, said first and second panels and said trays including cooperating means whereby said panels are slidably guided within the first and second trays, respectively, at positions in which the panels are adjacent to the inner surfaces of the tray bottoms for relative movement between them in the planes of the respective panels in directions perpendicular to the hinge axes; and foldable handle means movably mounted on at least one tray for suspending the trays and interconnecting liner while the trays are closed and for alternately supporting the trays in side-by-side positions across the inner while resting in upwardly-open, inclined positions.

2. The convertible carrying case and expandable easel of claim 1, wherein the walls of each tray include two parallel side walls extending across the width of its bottom and joined to a perpendicular end wall;

the width of each panel being equal to or less than the width of each inner surface across the respective tray bottoms.

3. The convertible carrying case and expandable easel of claim 1, wherein the walls of each tray include two parallel side walls extending across the width of its bottom and joined to a perpendicular end wall;

the width of each panel being equal to or less than the width of each inner surface across the respective tray bottoms; and locking means on the panels and trays for selectively positioning the panels relative to the tray engaged by it with the spine of the liner arranged across the open end of the enclosure formed by the two trays when folded together to a closed position about the hinge axes of the liner.

4. The convertible carrying case and expandable easel of claim 1 wherein the liner is constructed from a single sheet of material scored along parallel lines at each side of the spine to define said parallel hinge axes.

5. The convertible carrying case and expandable easel of claim 1 wherein the foldable handle means comprises:

an identical bent handle pivotally mounted to each tray; and brackets fixed to each tray for selectively positioning the handles between positions that facilitate suspension of the trays when closed and support of the individual trays when opened.

* * * * *